US005842286A

United States Patent [19]

Cantor

[11] Patent Number: 5,842,286

[45] Date of Patent: Dec. 1, 1998

[54] MULTI-FUNCTIONAL HAND-HELD HAIR DRYER

[76] Inventor: Josef Cantor, 129 Inglewood Way, Greenville, S.C. 29615

[21] Appl. No.: 72,338

[22] Filed: May 4, 1998

[51] Int. Cl.[6] ..... A45D 20/10

[52] U.S. Cl. ..... 34/96; 34/97; 34/98

[58] Field of Search ..... 34/90, 91, 96, 34/97, 98, 99

[56] References Cited

U.S. PATENT DOCUMENTS

| | | | |
|---|---|---|---|
| 4,198,556 | 4/1980 | Crowley et al. | 219/370 |
| 4,198,557 | 4/1980 | Crowley | 219/370 |
| 4,198,558 | 4/1980 | Benty | 219/370 |
| 5,148,512 | 9/1992 | Owens | 392/383 |
| 5,157,757 | 10/1992 | McDougall | 392/383 |
| 5,344,314 | 9/1994 | Zagoroff et al. | 432/222 |
| 5,467,540 | 11/1995 | Bastien | 34/97 |
| 5,598,640 | 2/1997 | Schepisi | 34/97 |
| 5,661,910 | 9/1997 | Schepisi | 34/97 |

*Primary Examiner*—Henry Bennett
*Assistant Examiner*—Pamela A. Wilson

[57] ABSTRACT

A blow dryer is provided which can be used as a gun-type blower/dryer and as an elongated styler/dryer comprising a conventional body section and a barrel which includes a barrel end opening and a plurality of holes along the periphery of the barrel wherein separate chambers are provided in the barrel to direct the desired concentration and velocity of hot air to the barrel end opening and the holes along the periphery of the barrel.

11 Claims, 2 Drawing Sheets

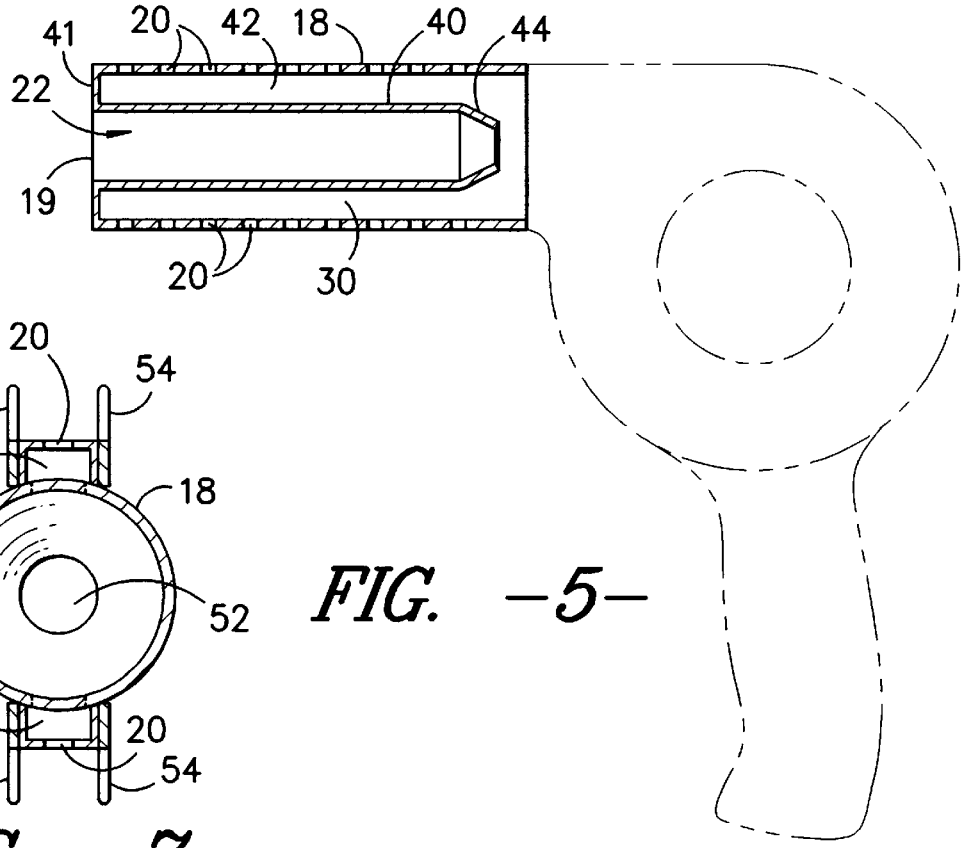
FIG. —5—
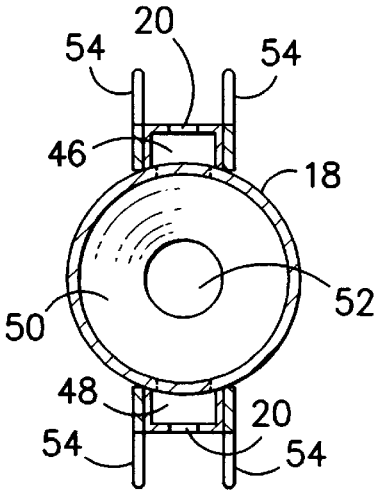
FIG. —7—
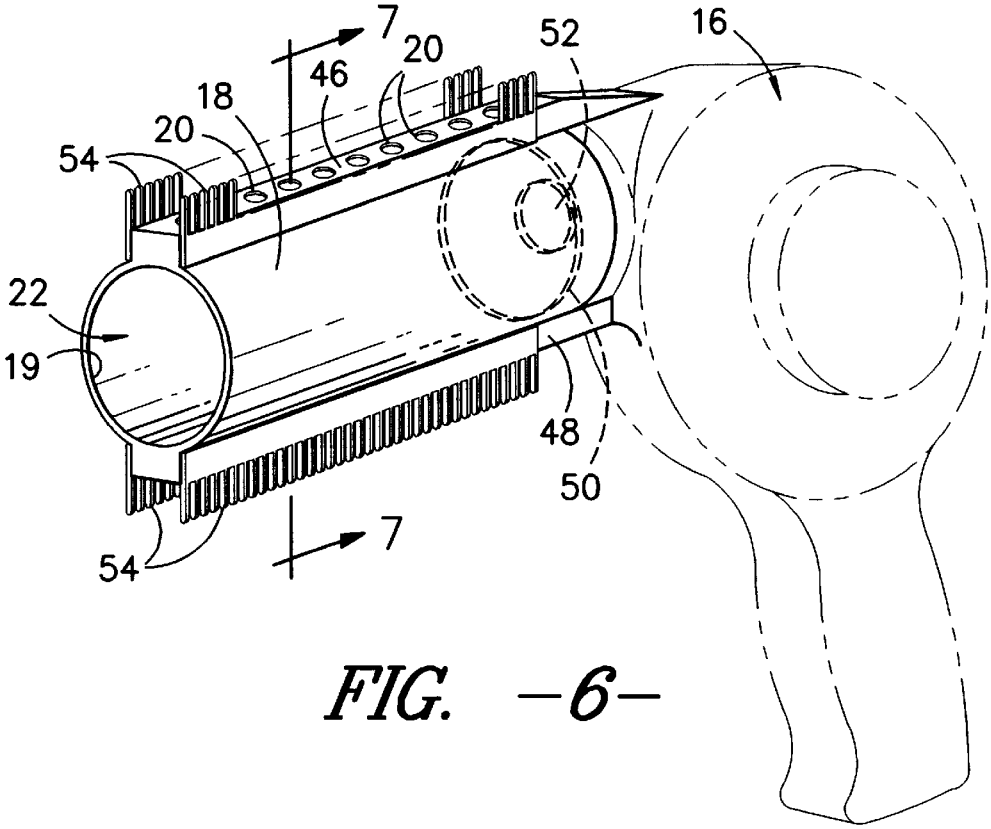
FIG. —6—

MULTI-FUNCTIONAL HAND-HELD HAIR DRYER

BACKGROUND OF THE INVENTION

Portable hand-held hair dryers with heated air outputs have been used extensively both by barbers and in beauty salons as well as by individuals in the home for many years. As the home market has increased in recent years, these appliances have developed primarily in two separate and distinct categories, the blower/dryers and the styler/dryers.

Blower/dryers are used primarily for drying the user's hair and provide a hot concentrated air flow. Such appliances typically have a cylindrical portion from which the hot air exits axially out one end thereof. The air outlet opening is relatively small and thus provides a high velocity concentrated air flow. With the high velocity air flow, the temperatures used in such blower/dryers can be extremely high without creating a risk of internal heat build-up by the heating elements and as such, the drying power of these devices is quite high. The most common blower/dryer configuration is the gun-type unit in which a handle portion extends downwardly at a right angle from the cylindrical body portion of the product. The motor and a centrifugal fan are positioned at the junction of the handle and body portion. Electrical heating elements are provided between the fan and the frontally located air outlet. Attachments such as a brush or comb cannot be used with such blower/dryers and, if brushing or combing is desired for styling, the consumer must use both hands, the blower being held in one and a brush or comb in the other. The gun-type configuration for a blower/dryer, however, is convenient to use and efficient if a second person is drying the actual user's hair, such as a professional hair stylist.

A styler/dryer appliance, on the other hand, is characterized by having various styling attachments, such as a brush or a comb, and typically has an elongated body with a head portion in which the hot air flow exits laterally therefrom. Thus, the appliance can be manipulated in the same fashion as is a common brush with one's hair being dried and styled as the user merely brushes or combs his or her hair. A typical construction of a styler/dryer incorporates a tangential fan within the head portion thereof with the heating elements being positioned between the fan and the lateral air outlet. The air outlet contained in styler/dryers is of a larger area than that of the typical blower/dryer and consequently the air exits through this outlet at a lower velocity. This lower velocity and less concentrated air flow will not tend to adversely blow or scatter the user's hair as much as the high velocity air in the blower/dryer, thereby facilitating the styling operation.

The preferred and most efficient manner of preparing one's own hair would be to use a blower with its high temperature and concentrated air flow during the initial drying process and, after the hair has been partially dried, to use a styler/dryer to complete the drying and to properly style the user's hair. In view of these considerations, it would be advantageous to have a single, portable hand-held product that would provide the functions and advantages of both a blower/dryer appliance as well as a styler/dryer appliance.

Prior efforts to provide the combined functions of a blower/dryer and a styler/dryer appliance in one hand-held unit have been suggested. More particularly, the idea of a hair blower having means for delivering the air outwardly through the end of the barrel or blocking the end of the barrel and causing the air to flow out the side of the barrel are, in general, known.

For instance, U.S. Pat. Nos. 5,661,910 and 5,598,640, both issued to Schepisi, disclose a hand-held blow dryer in which the air may be directed axially through the end of a barrel, or the end may be closed by deflectors, causing the air to be directed radially out of the barrel through holes.

U.S. Pat. Nos. 4,198,556; 4,198,557; and 4,198,558, all assigned to Sunbeam Corporation, disclose a hair blower which may be used in a gun configuration with air flowing out through the end, or may be used with the handle in line with the barrel so that air is blocked from going out the end and goes out the side for use as a styler/dryer.

U.S. Pat. Nos. 5,148,512 and 5,157,757 both disclose other arrangements for a hair dryer in which air flow may pass through the end or through the sides of the barrel.

These prior efforts to provide a multifunctional unit, however, are all characterized by having a multitude of moving parts to either direct the air out of the barrel end or alternatively out of the sides of the barrel. The requirement for such moving parts adds complexity and hence cost to the construction of the units which are typically mass marketed and price sensitive. Additionally, such moving parts tend to break especially where they are used in association with the materials typically used in the construction of mass marketed hair dryers.

SUMMARY OF THE INVENTION

The present invention provides an improved hair drying appliance which can be used as a gun-type blower/dryer and as an elongated styler/dryer without the necessity of employing complicated additional moving parts which may break or attachments which may be lost or misplaced.

The blow dryer arrangement of the present invention adds functionality to the blow dryer by allowing simultaneous airflow from the barrel surface as well as from the barrel end. This permits the blow dryer of the present invention to be utilized for horizontal lifting/drying/styling as well as a hot roller and diffuser.

The blow dryer arrangement of the present invention may incorporate a standard barrel opening and also holes on the barrel surface. The barrel of the dryer is provided with chambers that are designed so that hot air exits the barrel end at a high temperature and concentration typically desired during the initial drying process, while at the same time providing air at a somewhat lower velocity through the peripheral holes, typical of a styler/dryer to complete the drying and to properly style the user's hair. The apparatus of the present invention, furthermore, provides hot air through the peripheral holes at a relatively uniform velocity along the length of the barrel; that is the velocity of air exiting peripheral holes near the barrel section nearest the body of the appliance where the hot air is generated may typically be no more than about ten percent greater than the velocity of the air exiting peripheral holes nearest the barrel end opening. Such relatively uniform air flow may be quite important to achieve a desired styling function in the appliance.

The present invention therefore provides a blow dryer which comprises a body including a barrel having a barrel opening, with the barrel including a plurality of holes; the barrel being comprised of at least two chambers, at least one of said chambers being open-ended for the transfer of air to the barrel end opening and at least one of said chambers being closed-ended to transfer air to the holes in the periphery of the barrel.

Further objects and advantages of the invention will become apparent as the following description proceeds and features of novelty which characterize the invention will be pointed out with particularity in the claims annexed to and forming a part of this specification.

BRIEF DESCRIPTION OF THE DRAWINGS

FIG. 5 is a cross-sectional view of a longitudinal section of the barrel assembly of the dryer appliance.

FIG. 6 is a perspective view of the hair drying appliance illustrating an embodiment wherein the chambers, providing air to openings substantially along the length of the barrel are positioned outside of the periphery of the barrel and the appliance is provided with combs along the length of the barrel to assist in styling.

FIG. 7 is a cross-sectional view of the barrel shown in FIG. 6.

DETAILED DESCRIPTION OF THE DRAWINGS

Figure 1:
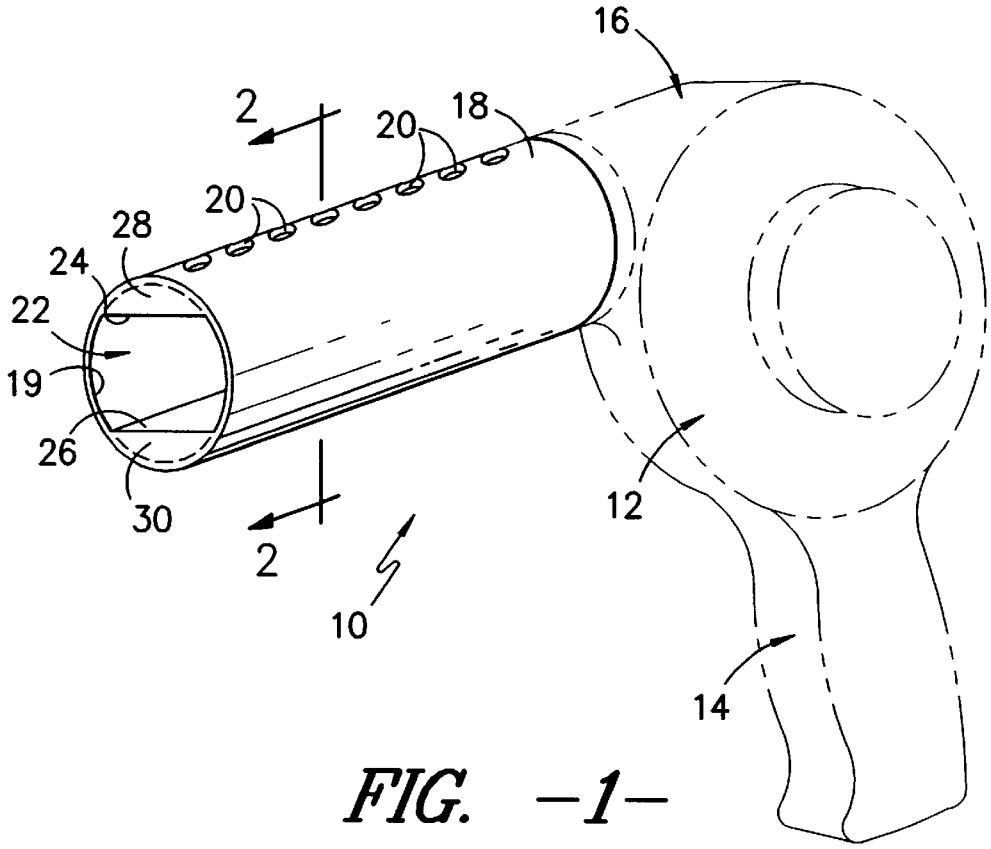
FIG. 1 is a perspective view of the hair drying appliance embodying the present invention.

Referring now to the drawings, there is shown in FIG. 1 a hair dryer appliance designated generally by reference number 10. The hair dryer as shown is a gun-type configuration having a plastic housing 12. The dryer is provided with a conventional handle section 14, a cylindrical body housing 16. A motor and centrifugal fan (not shown) are positioned at the junction of the handle 14 and body housing 16. Electrical heating elements (also not shown) are provided between the fan and a frontally located air outlet. Connected to body housing 16 is barrel section 18 which is provided with a barrel end opening 19 and peripheral barrel openings 20. Barrel openings 20 are also provided on the under side of barrel 18. In the embodiment of the invention shown in FIG. 1, the barrel is provided with three chambers, a central chamber 22 defined by the interior walls of barrel 18, an upper barrel partition 24 and a lower barrel partition 26, an upper chamber 28 defined by the interior wall of barrel 18 and upper partition 24 and a lower chamber 30 defined by interior wall of barrel 18 and lower partition 26.

Central chamber 22 functions to transfer hot air from the body housing 16 where it is generated to barrel end opening 19. Upper chamber 28 serves to transfer hot air from body housing 16 to peripheral barrel openings 20 provided on the upper periphery of barrel 18 and lower chamber 30 serves to transfer hot air from body housing 16 to peripheral barrel openings provided along the lower periphery of barrel 18. Upper chamber 28 and lower chamber 30 are both closed to the passage of air at or near the barrel end so that once hot air enters those chambers from body housing 16 it can egress only through peripheral openings 20. By means of this configuration, the desired distribution of hot air flow between barrel opening 19 and peripheral openings 20 may be achieved. A flow of hot concentrated air is provided to the barrel opening 19 to perform the blow drying function and, simultaneously, the desired concentration of hot air is provided to the holes 20 along the periphery of barrel 18 to perform the desired styling function of the appliance without the necessity of providing additional moving parts to the appliance to perform those functions separately using a singe appliance. The barrel of the dryer is provided with chambers that are designed so that hot air exits the barrel end at a high temperature and concentration typically desired during the initial drying process, while at the same time providing air at a somewhat lower velocity through the peripheral holes, typical of a styler dryer to complete the drying and to properly style the user's hair.

Figure 2:
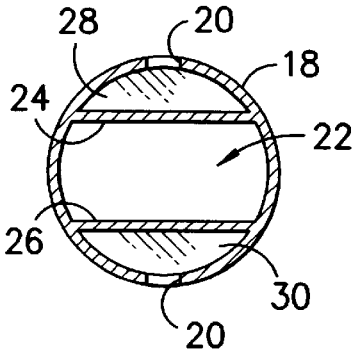
FIGS. 2, 3 and 4 are cross-sectional views showing a variety of embodiments taken generally on one 2—2 of FIG. 1.

FIG. 2 is a cross-sectional view of barrel 18 taken along line 2—2 showing essentially the same embodiment of chamber arrangements show in FIG. 1 thus closed end chambers 28 and 30 transfer air to upper and lower peripheral holes 20 and open-ended chamber 22 transfers hot air to the barrel opening.

Figure 3:
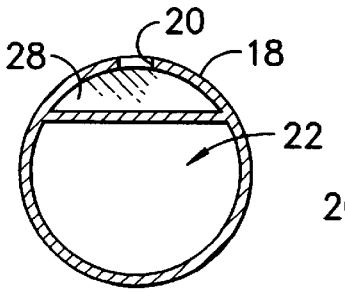
Figure 4:
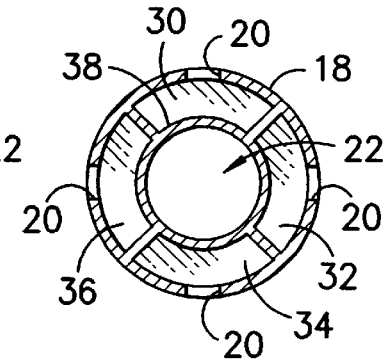

FIG. 3 and FIG. 4 show alternative embodiments of the invention with FIG. 3 showing only two separate chambers 22 and 28 and FIG. 4 showing a total of five separate chambers.

In the embodiment shown if FIG. 3, only one row of peripheral holes 20 is provided with closed end chamber 28 transferring hot air to holes 20. If only one row of peripheral holes 20 is provided it may be disposed at any desired position around the circumference of the dryer as may be desired for the convenience of the user of the appliance in performing the styling/drying function.

Shown in FIG. 4 are four separate closed-end peripheral chambers 30, 32, 34 and 36 which function to transfer hot air to four separate rows of peripheral holes 20. In FIG. 4 chamber 22 is defined by the inner walls of inner barrel 38. As will be apparent to those skilled in the art the precise arrangement of the peripheral holes 20, e.g. the number of rows of holes provided, the positioning of the rows, the positioning and spacing of the holes either along the entire length of the barrel or only a portion thereof may vary widely. Moreover the peripheral holes may not even be provided in rows but may be positioned in any desired configuration for the styling function around the periphery of the barrel. Similarly, the actual number and configuration of separate closed end chambers transferring hot air to peripheral holes 20 may vary widely. For instance only one chamber may be provided to transfer hot air to a single row of peripheral holes. Two or more separate chambers may also be provided or alternately the single chamber may extend around the entire periphery of the barrel with a separate interior barrel defining chamber 22 for the purpose of transferring hot air to the barrel end.

FIG. 5 shows a mechanism by which the design of the barrel and the chambers may be conveniently modified to achieve a desired distribution of hot air flow between the barrel end opening 19 and peripheral barrel openings 20. According to this embodiment chamber 22 is defined by the interior walls of inner barrel member 40. Inner barrel 40 is suspended in circumferential fashion from barrel member 18 by means of barrel end member 41. Barrel 18, inner barrel 40 and barrel end member 41 may be a single piece construction. Outer closed end chamber 42 is defined by the outer walls of inner barrel member 40 and functions to transfer air to peripheral holes 20. Inwardly directed circumferential flange 44 of fixed dimension is provided to direct a relatively greater volume of air to peripheral holes 20 while permitting somewhat less hot air to flow through barrel end opening 19. As will be apparent to those skilled in the art, if it is desired to direct a greater volume and velocity of hot air to barrel end opening 19, circumferential flange 44 may be flared outwardly.

FIG. 6 illustrates an embodiment of the present invention wherein barrel 18 is provided with separate chambers, namely upper chamber 46 and lower chamber 48 that function to transfer hot air from body housing 16 where it is generated to openings 20 provided in chambers 46 and 48 along the length of barrel 18. Chambers 46 and 48 as shown are actually outside of the normal periphery of barrel 18 and barrel 18 is provided with a baffle 50 of fixed dimension which functions to divert the desired amount of air from chamber 22 into chambers 46 and 48 through openings (not shown) in barrel 18 that are provided in the section of barrel 18 between baffle 50 and the connection joint between barrel 18 and body housing 16. Baffle 50 is provided with opening 52 that allows hot air to travel from body housing 16 through chamber 22 to barrel end opening 19. Also shown are styling combs 54 which are provided on both sides of openings 20 on the top and bottom of the barrel. Combs 20 may be either rigid as in a conventional comb or they may be flexible to resemble a brush. They may be closely adjacent to one another as in a conventional comb or they may be spaced apart as desired.

FIG. 7 is a cross-sectional view taken along line 7—7 in FIG. 6 looking back in barrel 18 toward body housing 16 not shown. Baffle 50 is shown which defines opening 52 of fixed dimension that allows the desired amount of air to travel through to the end of the barrel. Chambers 46 and 48 are shown on the exterior of barrel 18 which communicate hot air from body housing 16 to openings 20. Combs 54 are shown extending outwardly from the plane of openings 20 to facilitate the styling function of the appliance.

While there has been shown and described a single embodiment of the present invention, it will be apparent to those skilled in the art that numerous changes and modifications may be made without departing from the invention in its broader aspects and it is, therefore, contemplated in the appended claims to cover all such changes and modifications which fall within the true spirit and scope of the present invention.

What is claimed is:

1. A blow dryer is provided, comprising: a conventional body section for generating hot air and a barrel connected to said body section which includes a barrel end opening and a plurality of holes along the periphery of the barrel wherein separate chambers are provided in the barrel to direct the desired concentration and velocity of hot air to the barrel end opening and the holes along the periphery of the barrel.

2. The blow dryer of claim 1 wherein one of said chambers is open-ended for the transfer of air to the barrel end opening and at least one of said chambers is closed-ended to transfer air to said holes along the periphery of the barrel.

3. The blow dryer of claim 2 wherein said holes along the periphery of said barrel are arranged in at least one row substantially along the entire length of said barrel.

4. The blow dryer of claim 3 wherein said barrel is a single piece plastic construction having an outer barrel, an inner barrel connected by an end member defining a closed end outer section for directing hot air to said holes along the periphery of said barrel and an open-ended inner chamber directing hot air to the barrel end opening.

5. The blow dryer of claim 4, wherein said inner barrel member is flanged to direct a desired concentration and velocity of hot air to both the barrel end for initial drying of hair and to the holes along the periphery of the barrel to complete the drying function and to style the hair.

6. A gun-type, hand-held hair dryer providing simultaneously the ability to quickly dry hair and complete drying and style the hair, which comprises a cylindrical body section for generating hot air, a handle section connected to said body section, a barrel operably connected to said body section, said barrel being comprised of at least two chambers, at least one of said chambers being open-ended to transfer hot air at a high velocity from said body section to an opening at the end of the barrel and at least one of said chambers being closed-ended to transfer hot air from the body section to holes in the periphery of said barrel.

7. The gun-type, hand-held hair dryer of claim 6 wherein said holes in the periphery of said barrel are arranged in at least one row substantially along the entire length of said barrel.

8. The gun-type, hand-held hair dryer of claim 6 wherein at least one of said chambers is provided with chamber walls the ends of which are flared to operably distribute the desired concentration and velocity of air to said opening at the end of said barrel and the openings along the periphery of said barrel.

9. The gun-type, hand-held hair dryer of claim 6 wherein said barrel is a single piece plastic construction.

10. A gun-type, hand-held hair dryer providing simultaneously quick drying and proper styling of the hair, which comprises a cylindrical body section for generating hot air, a handle section connected to said body section, a barrel operably connected to said body section, said barrel defining an open-ended chamber for transferring hot air at a high velocity from said body section to an opening at the end of the barrel, said barrel also being provided with at least one closed-ended chamber attached to the periphery of said barrel extending along the length of said barrel for transferring hot air to openings in chamber extending along the length of said chamber, said barrel being provided with a baffle of fixed dimension to enhance the flow of hot air into said closed-ended chamber, and said barrel being further provided with protrusions to facilitate styling of the hair.

11. The hair dryer of claim 10, wherein said barrel is provided with a baffle of fixed dimension to enhance the flow of hot air into said peripheral chamber.

* * * * *